United States Patent [19]

Domig et al.

[11] 4,031,924

[45] June 28, 1977

[54] ELECTRONIC EQUIPMENT FOR MONITORING YARN TRAVEL ON A TEXTILE MACHINE

[75] Inventors: René Domig, Kusnacht; Ernst Morf, Zurich; Erich Loepfe, Zollikerberg, all of Switzerland

[73] Assignee: Aktiengesellschaft Gebrueder Loepfe, Wetzikon, Switzerland

[22] Filed: Apr. 8, 1976

[21] Appl. No.: 675,140

[30] Foreign Application Priority Data

Apr. 23, 1975 Switzerland ..... 5200/75

[52] U.S. Cl. ..... 139/336; 139/341; 139/370.2; 139/371; 66/163

[51] Int. Cl.[2] ..... D03D 51/18; D03D 51/34; D03D 51/40

[58] Field of Search ..... 139/336, 341, 344, 370.1, 139/370.2, 371; 66/163; 340/259

[56] References Cited

UNITED STATES PATENTS

| | | | |
|---|---|---|---|
| 3,440,634 | 4/1969 | Maurmann et al. | 139/370.2 |
| 3,467,149 | 9/1969 | Dosch et al. | 139/371 |
| 3,688,958 | 9/1972 | Rydborn | 139/370.2 |
| 3,757,831 | 9/1973 | Loepfe et al. | 139/341 |
| 3,970,115 | 7/1976 | Kenk et al. | 139/370.1 |

*Primary Examiner*—Henry S. Jaudon
*Attorney, Agent, or Firm*—Werner W. Kleeman

[57] ABSTRACT

The present invention relates to equipment for monitoring the yarn travel on a textile machine, particularly in the shuttle of a weaving loom, comprising a piezoelectrical yarn sensing unit mounted in the shuttle and an electronic receiving circuitry outside the shuttle. The sensing unit transmits yarn travel signals of a frequency which is determined by one of the natural frequencies of the sensing unit, and the electronic receiving circuitry comprises at least one resonant circuit tuned to that natural frequency.

12 Claims, 11 Drawing Figures

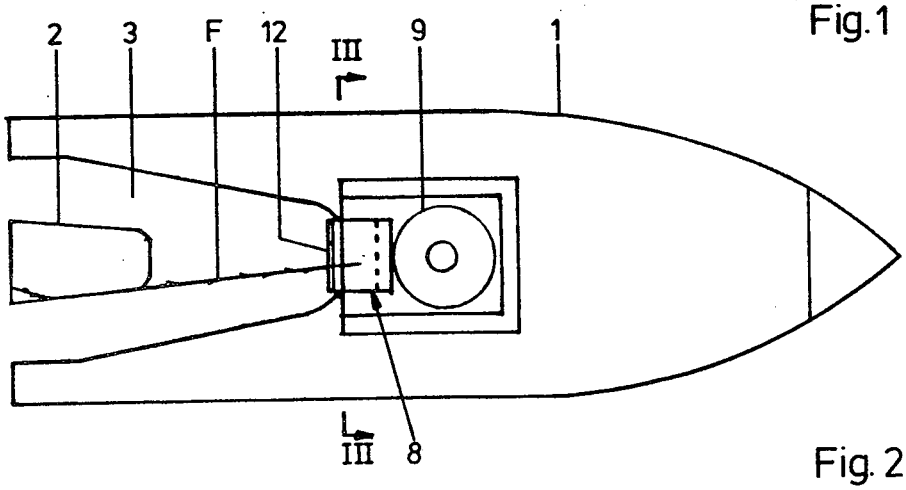
Fig. 1
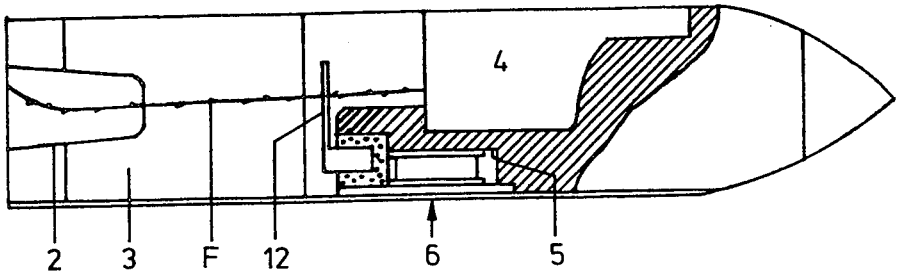
Fig. 2
Fig. 3
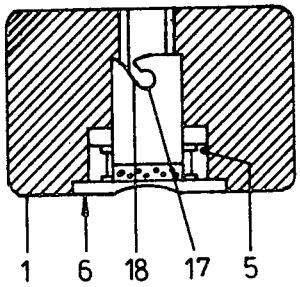
6
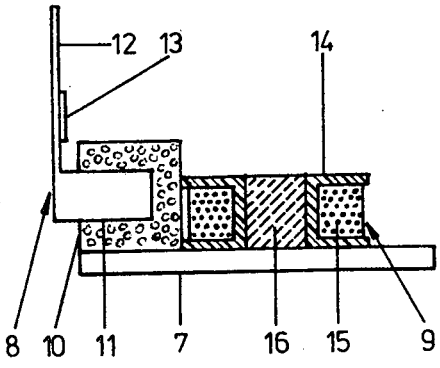
Fig. 4

Fig.5
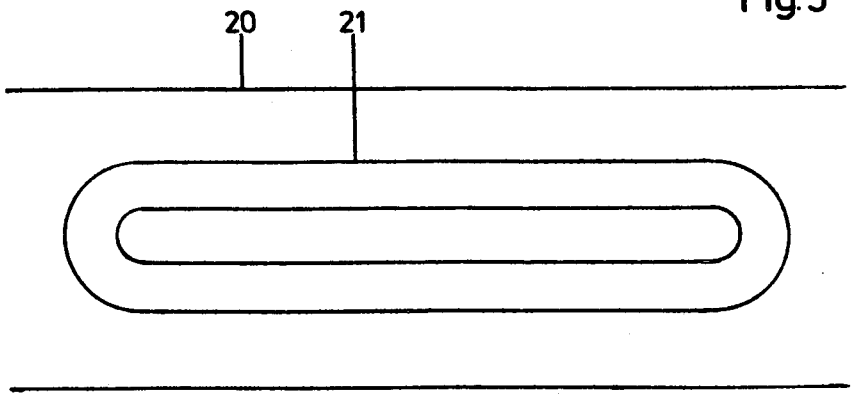
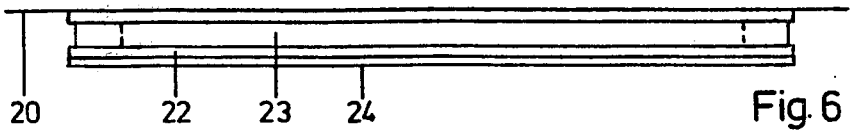
Fig. 6
Fig.7
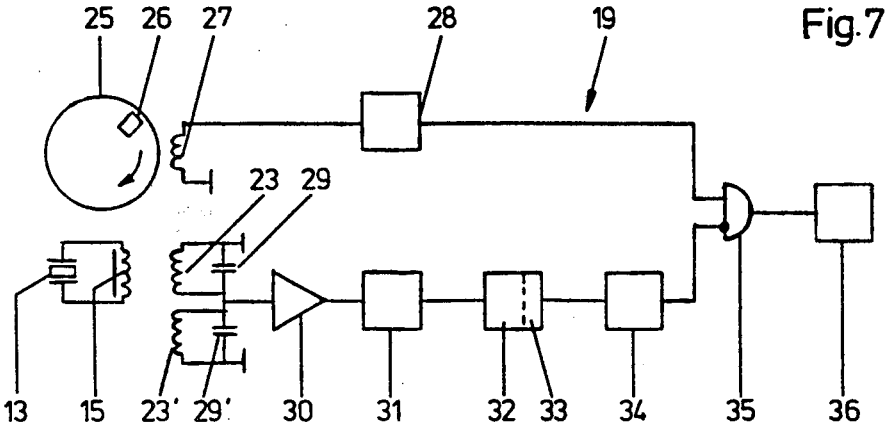

ELECTRONIC EQUIPMENT FOR MONITORING YARN TRAVEL ON A TEXTILE MACHINE

BACKGROUND OF THE INVENTION

The present invention relates to new and improved equipment for monitoring the yarn travel on a textile machine, particularly in the shuttle of a loom where the weft or filling yarn is drawn from a bobbin.

Various devices of the type using electromagnetic or piezoelectric transducers for sensing and monitoring the weft or filling yarn in the shuttle of a weaving loom have been described in patent literature. However, no such device has been introduced in practice in weaving mills. The reason for this failure is that conditions must be placed upon such weft monitors which cannot be met with the hitherto proposed means during the rugged weaving operations. First of all, these conditions impose permanent operating reliability over long working periods, requiring the sensing means arranged in the shuttle to have a high resistance to dust and corrosion, and further to the extraordinary accelerations which occur on picking and braking the shuttle and which tend to deform or even destroy the sensing means.

Another equally indispensable demand is that the sensing and monitoring device generates yarn travel signals large enough to safely stop the loom in the event of a yarn break, and to avoid undesired stops in the presence of spurious signals of the various types occurring under normal working conditions. Since the demand for ruggedness of the sensing device is inconsistent with the latter condition, it is extremely difficult to realize a satisfactory solution of the problem in question.

Some known weft or filling yarn monitoring devices or weft stop motions comprise electrical circuits disposed in the shuttle and provided with a contact which is held open by the traveling tightened yarn and closed when the yarn tension decreases, thus completing the electrical circuit and tripping a stop signal. Such devices, by way of example, are described in German patent publications Nos. 1,253,647 and 1,710,442. Contacts of that type are responsive to the high accelerations occuring on picking the shuttle, even in the case that the contacts are sealed against effects from outside. Moreover, any type of sensing device mainly responsive to the tension of the yarn is unapt for monitoring those phases of the shuttle flight when the tension of the weft or filling yarn is small.

Thus, sensing devices which have no contacts and are responsive to the travel of the yarn, particularly piezoelectrical yarn sensing and monitoring devices, are preferred. By way of example, such a device is known from U.S. Pat. No. 3,467,149 and Swiss Pat. No. 441,172. This known sensing device has a low mechanical resonant frequency in the range of 1 to 2 KHz and comprises a base member, a piezoelectrical crystal connected to the base member by two mounting elements, and an L-shaped thread feeler element attached at one of its ends to the base member and having a free arm in parallel relationship to the piezoelectrical crystal. The thread feeler element is mechanically coupled to the piezoelectrical crystal by a vibration coupling member. Additionally, an electrical resonant circuit tuned to a high-frequency of a few MHz is provided in the sensing device, comprising an induction coil and a variable capacitance diode. The piezoelectrical crystal is connected in parallel to the doide such that the capacitance characteristic of the diode changes at a rate corresponding to the vibration frequency of the thread feeler element or crystal. As a result, the resonant frequency of said high-frequency resonant circuit shifts at the vibratory rate. By such a shift, a second resonant circuit disposed in the lathe or sley beam and driven by a generator producing a high-frequency signal in the MHz range is influenced such as to produce a signal modulated by the low-frequency of the sensing device. That low-frequency modulation indicates the travel of the yarn in the shuttle.

The aforementioned patents do not discuss the problems of the ruggedness of the piezoelectrical sensing device and the suppression of spurious signals.

SUMMARY OF THE INVENTION

It is a primary object of the present invention to provide further developments and improvements on the monitoring and sensing devices of the aforementioned types.

It is a more specific objective of the present invention to procure weft or filling thread monitors and sensing devices which are rugged and reliable when working continuously over long periods of time.

Another objective of the present invention is the provision of monitoring and sensing devices exhibiting an improved signal-to-noise ratio in the yarn travel indicating signals.

Now in order to implement the aforementioned objectives and others which will become more readily apparent as the description proceeds, the equipment of the present invention is characterized in that there is provided piezoelectrical yarn sensing means intended to be arranged at a moving part of the textile machine, and electronic receiving means intended to be mounted outside said moving part of the textile machine; said piezoelectrical yarn sensing means comprising a piezoelectrical transducer element and a yarn sensing member forming a mechanical vibratory system, and an induction coil having a winding electrically connected to the piezoelectrical transducer element; the induction coil winding and piezoelectrical transducer element constituting a first electrical resonant circuit tuned to one of the natural frequencies of said mechanical vibratory system; and the electronic receiving means comprising at least one further electrical resonant circuit tuned to said natural frequency.

BRIEF DESCRIPTION OF THE DRAWINGS

The invention will be better understood and objects other than set forth above will become apparent upon consideration of the following detailed description thereof which refers to the annexed drawings wherein:

FIG. 1 shows the front end of a conventional weaving shuttle with built-in sensing device, viewed in the direction of the bottom of the shuttle;

FIG. 2 is a side view of the front end represented in FIG. 1, partially broken away to show the sensing device;

FIG. 3 shows a cross-section of the shuttle, taken along the line III—III in FIG. 1, and the sensing device in end view;

FIG. 4 is a side view of the sensing device comprising the induction coil in cross-sectional view;

FIG. 5 is a schematic top plan view of part of the shuttle race of a weaving loom with a built-in receiving coil;

FIG. 6 shows the receiving coil as viewed from the front side of the weaving loom;

FIG. 7 is a schematic representation of the electronic circuitry of the monitoring equipment;

DETAILED DESCRIPTION OF THE INVENTION

Figure 8:
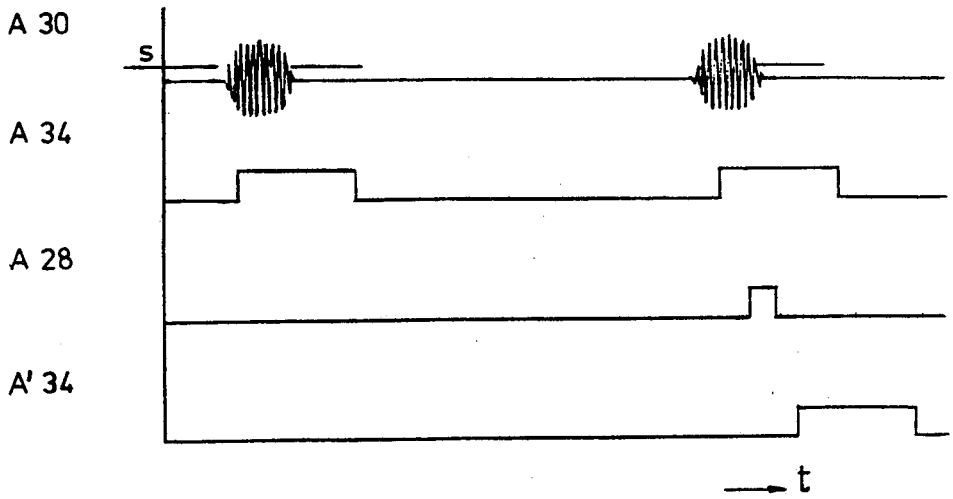
FIGS. 8 and 9 are graphs of pulses demonstrating the mode of operation of the electronic circuitry depicted in FIG. 7.

With reference to FIGS. 1, 2 and 3, shuttle 1 comprises an interior space 3 housing a supply or weft bobbin 2 which supplies the weft yarn or thread F. There is provided a first recess 4 in the top of shuttle 1 for receiving a conventional threader (not shown), and a second recess 5 of rectangular circumference at the bottom of shuttle 1 which receives a piezoelectrical sensing device or unit 6.

Sensing device or unit 6, shown in detail in FIG. 4, comprises, as its main components, a support or base plate 7, a transducer system 8 and an induction coil 9 supported by base plate 7. Transducer system 8 is mounted at base plate 7 by means of a soft elastic shock and vibration absorbing bearing material 10, such as sponge or foamed rubber or synthetic material which may be bonded to base plate 7 and transducer system 8 by cementing. In FIG. 1 base plate 7 is assumed to be transparent in order to discern the arrangement of transducer system 8 and induction coil 9 which may be also connected to base plate 7 by cementing.

Transducer system 8 comprises a square block 11, a plate-shaped resilient sensing member 12 fixedly connected to block 11, and a plate-shaped or laminar piezoelectrical transducer element 13 cemented to sensing member 12. Block 11 and sensing member 12 may preferably consist of metal, such as brass, and may be manufactured as single parts or an integral unit. In any case, the lower end of sensing member 12 is fixedly attached to block 11. The mass of block 11 should be greater than the combined masses of the free portion of sensing member 12 and the thereto bonded transducer element 13. Sensing member 12 and transducer element 13 constitute a unilaterally fixed or clamped flexural vibratory unit.

By using a ceramic piezoelectrical material, such as lead zirconate titanate, and rigidly bonding transducer element 13 to sensing member 12 there is formed a vibratory system largely unsusceptible to mechanical effects, such as impacts and picks. Moreover, the influence of picks upon the vibratory unit is substantially suppressed by the combined action of the heavy block 11 and vibration absorbing bearing material 10.

As shown in FIG. 3, the upper free end of sensing member 12 is provided with a thread guide 17 shaped as a circular opening, and a threading slot 18 slants from one of the upper edges of sensing member 12 into circular opening 17. As may be seen from FIGS. 2 and 4, sensing member 12 is arranged at the side of transducer system 8 facing weft bobbin 2. Filling or weft thread F is drawn from weft bobbin 2 in a direction substantially perpendicular to sensing member 12, and travels through thread guide 17 towards the threader arranged in recess 4. It is advantageous to line the edges of thread guide 17 and threading slot 18 with a hard coating, such as ceramic oxide (not shown).

With reference to FIG. 4, the flat induction coil 9 comprises a coil form 14, a core 16 and a wire winding 15. Core 16 is made of soft magnetic material, preferably ferrite. Winding 15 is connected to electrodes (not shown) of piezoelectrical transducer element 13 by wire connections (not shown), such as to form a first resonant circuit together with transducer element 13. This first resonant circuit is tuned to one of the natural resonant frequencies of the mechanical vibratory system comprising sensing member 12 and transducer element 13. That tuning serves for generating a large information or yarn travel signal and may be performed by conveniently dimensioning transducer element 13 and induction coil 9, and adjusting core 16 in induction coil 9.

Generally there is only a small space available in shuttle 1 for mounting sensing device or unit 6, as may be seen from FIG. 2. As a consequence, it is not possible to design induction coil 9 or the inductance thereof great enough for tuning said first resonant circuit to a frequency in the KHz range and corresponding to the fundamental natural frequency of the mechanical vibratory unit 12,13. Using a piezoelectrical ceramic material of high dielectric constant for transducer element 13, the latter may be endowed with a high capacitance, so that natural resonant frequencies in a range of some 10 KHz corresponding to an overtone of the mechanical vibratory system 12,13 may be easily realized, without including an additional capacitor in the resonant circuit.

The piezoelectrical transducer element 13 is electrically excited by the electrical reaction of the first resonant circuit 13,15 (FIG. 7) when the weft or filling yarn F is drawn off bobbin 2. Thereby, the mechanical vibratory unit 12,13 is periodically impulsed by the vibration of transducer element 13. This results in yarn travel signals substantially stronger and more continuous than those generated with known sensing systems not making use of said phenomenon. By this action, it is possible to operate the monitoring equipment at a relatively high resonant frequency, suppressing spurious signals in the acoustical range in a very effective manner.

The relatively great mass of block 11 and the mounting thereof on a soft elastic shock and vibration absorbing material 10 have the effect that vibrations and sound transmitted from outside onto shuttle 1, or stimulated in the shuttle by picks etc., do not cause undesired mechanical vibration of the vibratory unit comprising sensing member 12 and transducer element 13. Moreover, such mounting tends to cancel undesired mechanical effects, by which the transducer system 8 might be brought out of adjustment, or even damaged.

FIGS. 5 and 6 show one of the receiving coils 21 mounted in the top of the lathe beam 20. Receiving coil 21 comprises an elongated coil form 22 and a thereon arranged winding 23 which may be made of thin insulated copper wire. A shielding sheet 24 is provided beneath coil 21 for protecting winding 23 from external electromagnetical stray fields. With reference to FIG. 7, a capacitor 29 also arranged in lathe beam 20 is connected in parallel with winding 23 of receiving coil 21. Winding 23 of receiving coil 21 and capacitor 29 form a second resonant or parallel resonant circuit 23,29.

Receiving coil 21 is shaped elongated in the lengthwise direction of lathe beam 20 in order to ensure that an A.C. signal long enough for being readily evaluated may be produced by inductive transmission from resonant circuit 13,15 when shuttle 1 passes receiving coil 21. The duration or period of said A.C. signal depends on the speed of shuttle 1 as well as the length of receiving coil 21 and may be, by way of example, about 5 milliseconds. Assuming a shuttle speed of 10 meters per second, this corresponds to a length dimension of receiving coil 21 of about 5 cm. Of course that length may be greater, or smaller, however care should be taken that the noise level caused by stray fields is not increased to an undesirable degree. Shielding sheet 24 mainly serves for suppressing the effect of stray fields from beneath lathe beam 20.

In lathe beam 20 near the middle of the length thereof a single receiving coil 21 may be arranged for monitoring during the working cycles of the shuttle flight in both directions, i.e. the travel of shuttle 1 from left to right, and vice versa. Such an arrangment of a receiving coil in a shuttle flight monitor comprising a permanent magnet in the shuttle is disclosed in U.S. Pat. No. 3,613,742. However, it is advantageous to provide two separate receiving coils 23,23', FIGS. 7 and 11, either receiving coil serving for monitoring the working cycles in one direction of the shuttle flight. A coil arrangement of this kind for monitoring the flight of a shuttle is shown in U.S. Pat. No. 2,586,335.

With such an arrangement of the receiving coils between the midpoint and the ends of lathe beam 20 in the inventive monitoring equipment the weft or filling thread is monitored in a later time interval within the working cycles, compared with a single receiving coil disposed in the length midpoint of lathe beam 20. As a result, it is possible to detect thread breaks and thread ends which occur relatively late in the working cycle. It should be noted that the shuttle flight monitoring devices disclosed in the above mentioned United States patents evaluate the regularity of the shuttle flight rather than the orderly travel of the weft or filling thread in the shuttle.

In the electronic circuitry of FIG. 7, there is shown, by way of example, the transmitting or first resonant circuit 13,15 and electronic receiving circuitry 19 of the inventive monitoring equipment. The latter comprises a trigger device 26,27,28 driven in synchronism with the loom drive and defining the time intervals in which the weft or filling thread is monitored. The trigger device comprises a permanent magnet 26 attached to a rotating disc 25 coupled with the crank shaft of the weaving loom, a trigger coil 27 mounted on the frame of the loom near the periphery of disc 25, and a trigger pulse generator 28, e.g. a monostable multivibrator or monoflop, connected to trigger coil 27. In the present case, such a crank shaft controlled trigger device is more advantageous than a device in which the trigger pulse is generated by a permanent magnet disposed in the shuttle, since the magnet tends to disturb the weft or filling thread monitoring by its action upon the receiving coils arranged in the lathe beam; moreover, trigger device 26,27,28 suppresses, when the shuttle passes the first of the receiving coils, the so-called arrival pulse, as will still be explained in detail with reference to FIG. 8.

By way of example, one of two receiving coils having windings 23 and 23', respectively, may be arranged near either end of lathe beam 20. A thread travel signal is generated in the tuned signal forming circuitry 13,15,23,29,23',29' shown in FIG. 7 and comprising three resonant circuits 13,15; 23,29; and 23',29'. The first resonant circuit 13,15 is disposed in shuttle 1 and comprises piezoelectrical transducer element 13 and coil winding 15 of induction coil 9, FIG. 1, as mentioned above. The associated receiving circuitry comprises the above mentioned second resonant circuit 23,29 including coil winding 23 and capacitor 29, and a third resonant circuit comprising coil winding 23' and a further capacitor 29'. The second and third resonant circuits are tuned, like the first resonant circuit 13,15 disposed in shuttle 1, to one of the natural frequencies of the mechanical vibratory unit 12,13 of sensing device or unit 6.

Either of the second and third resonant circuits 23,29; 23',29' may be terminated by an impedance transducer stage (not shown) which may also be arranged in lathe beam 20 and provided with a field-effect transistor. An evaluation circuitry 30 through 34 is connected to the outputs of said tuned signal forming circuitry, by means of wire connections, and comprises four serially connected stages: an input or band pass amplifier stage 30, a pulse shaper stage having threshold response or first threshold stage 31, an integration stage 32, a second threshold stage 33 an an output or blocking pulse generator stage 34, e.g. a monostable multivibrator. Band pass amplifier stage 30 passes only frequencies in a small band including the resonant frequency of the tuned signal forming circuitry 13,15,23,29,23',29', and suppresses spurious signal frequencies outside said small frequency band. The mode of operation of stages 31 through 34 will still be explained in connection with FIGS. 8 and 9.

The output of trigger pulse generator 28 is connected to the first input of a gate 35 which has a second negated input which is connected to the output of blocking pulse generator stage 34. The output of gate 35 is fed to the input of a stopping device 36.

Evaluation circuitry 30 through 34 together with gate 35 may preferably be arranged in a switch box which is fixedly mounted on the frame of the weaving loom (not shown).

Figure 9:
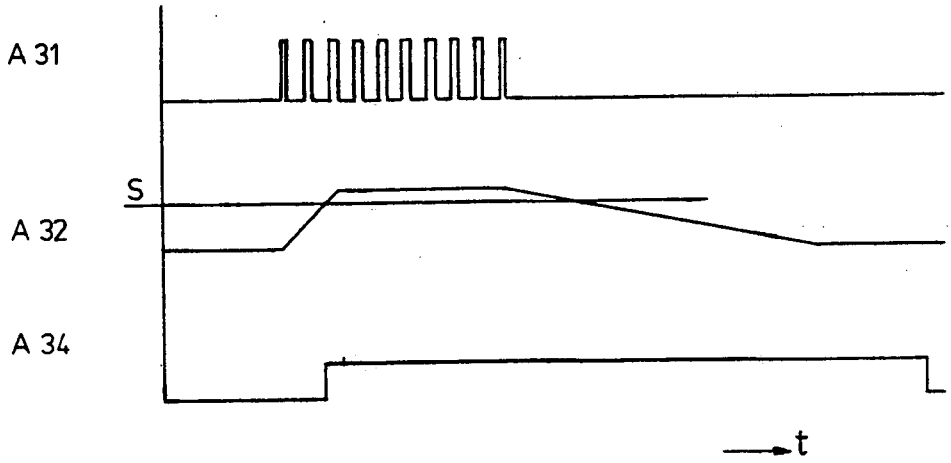

In FIGS. 8 and 9 there are shown, in somewhat simplified manner, the pulses occurring at the outputs of stages 28,30, 31,32 and 34 represented in FIG. 7. Each output pulse is labeled by the letter A in connection with the reference numeral of the stage producing that pulse.

With reference to FIG. 8, band pass amplifier stage 30 furnishes two vibration pulses A 30 in each working cycle of the weaving loom when shuttle 1 and induction coil 9 pass over receiving coils or windings 23,23'; each vibration pulse A 30 may occupy a time interval of about 5 ms, by way of example. The carrier frequency of vibration pulses A 30 corresponds with a natural frequency of the flexural vibratory unit 12,13, FIG. 4, which frequency is filtered out by said resonant frequencies. Evaluation circuitry 30 through 34 provides two rectangular blocking pulses of defined duration which is independent of the duration of the vibration pulses A 30 and may be about 20 ms, by way of example. The blocking pulses A 34 start some milliseconds later than vibration pulses A 30.

In each working cycle of the weaving loom trigger device 26,27,28 generates a rectangular trigger pulse A 28 of some milliseconds duration defining the time interval in which the second blocking pulse A 34 is sampled. The presence of a blocking pulse A 34 coincident with trigger pulse A 28 indicates firstly that thread F is traveling correctly from weft bobbin 2, and secondly that shuttle 1 has a speed sufficient for arriving in the shuttle box of the loom prior to the reed beat-up and closing of the weaving shed. Thus, the described embodiment of the inventive monitoring equipment additionally performs the functions of a shuttle flight monitor.

Within the time interval defined by blocking pulse A 34, gate 35 is blocked so that coincident trigger pulse A 28 cannot pass to stop device 36, and the latter remains idle, indicating that the weaving loom works correctly and weft or filling thread F is intact. However, when the blocking pulse is late—as shown at A'34—i.e. occurs after trigger pulse A 28, or is completely missing gate 35 remains opened so that trigger pulse A 28 passes to stop device 36, and the weaving loom is stopped.

FIG. 9 demonstrates the conversion of a vibration pulse A 30 of FIG. 8 into a blocking pulse A 34 by stages 31 through 34, FIG. 7. Pulse shaper stage 31 is responsive only to vibration pulses A 30, the amplitudes of which surmount a relatively low threshold value *s*, and furnishes a series of rectangular pulses A 31. Thus, the pulse shaper stage 31 suppresses spurious signals which may pass band pass amplifier stage 30, however exhibit low amplitudes. The output signals A 31 of pulse shaper stage 31 form a series of rectangular pulses which are integrated in integration stage 32, resulting in an almost trapezoidal pulse A 32 having a steep leading edge and a gentle rear slope.

The rise time of trapezoidal pulse A 32 may be about 2 ms, its decay time about 10 milliseconds, by way of example. Second threshold stage 33 associated with integration stage 32 is designed to respond to signals the amplitudes of which exceed a relatively high threshold value S, so that only the top of trapezoidal pulse A 32 is passed to output stage 34 of evaluation circuitry 30 through 34. By such a design, short-timed spurious signals of great amplitudes which have passed through band pass amplifier stage 30 are also eliminated. Output or blocking pulse generator stage 34 produces a rectangular blocking pulse A 34, the duration of which may be about 20 ms and which may be delayed by about 2 ms with respect to the outset of rectangular pulse series A 31.

Figure 10:
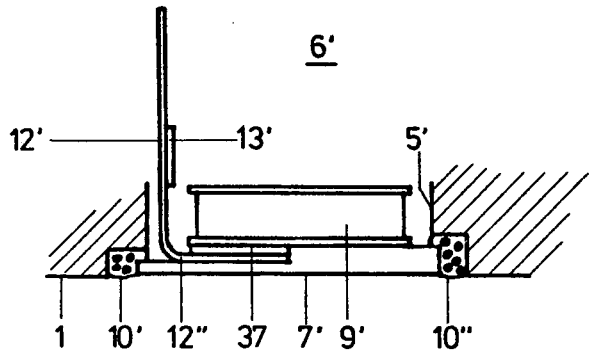
FIG. 10 shows a second embodiment of the inventive sensing device.

The sensing device or unit 6' shown in FIG. 10 differs from the one represented in FIG. 4 mainly in that the heavy block 11 is missing. The sensing member 12' is L-shaped, its lower bent-off section 12'' being directly attached to base plate 7'. Induction coil 9' overlaps bent-off section 12'', and a filling pad or plate 37 is disposed in the space between coil 9'' and bent-off section 12'', and fixed in that space e.g. by cementing. Thus, the united masses of base plate 7' and induction coil 9' take over the role of the inertia of block 11, FIG. 4. Base plate 7' may be supported in a recess 5' of shuttle 1 by soft eleastic material 10', 10'' which is resilient and absorbs vibrational energy. A piezoelectrical transducer element 13' shaped as a rectangular small plate and made of piezoelectrical ceramic material may be fixedly attached to the free vertical section of sensing member 12'. A thread guide may be provided at the upper free end of sensing member 12', in a similar manner as described with reference to FIG. 3.

Compared with the unit shown in FIG. 4, in the sensing unit 6' of FIG. 10 nearly the whole mass of the sensing unit, that means the mass thereof diminished by the mass of the free section of sensing member 12' and transducer element 13', takes over the function of the mass of block 11. It is possible to additionally protect the sensing unit shown in FIG. 4 against impacts and sound conducted through solids in a particularly effective manner by supporting base plate 7 and sensing unit 6 by means of a soft elastic vibration absorbing material in recess 5, in a similar manner as shown in FIG. 10.

Figure 11:
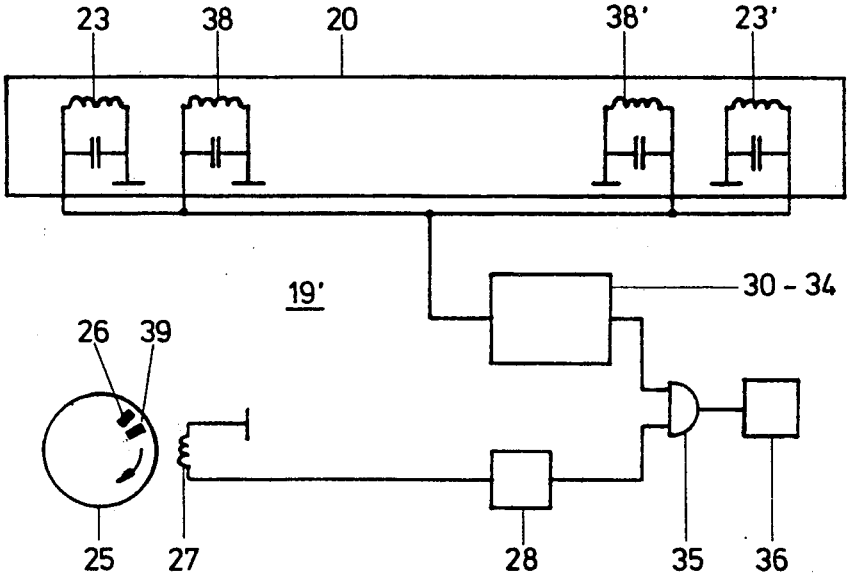
FIG. 11 shows an electronic circuitry comprising components for monitoring the flight of the shuttle.

FIG. 11 illustrates the extensibility of the monitoring equipment described with reference to the preceding Figures and particularly a possibility of designing same with relative little expense for additionally monitoring the shuttle flight. Schematically FIG. 11 shows an electronic receiving circuitry 19' of such a combined weft thread and shuttle flight monitor comprising two pairs of receiving coils disposed in the lathe beam 20 and including windings 23,23' and 38,38', respectively. The former pair of coils serves for monitoring the weft or filling thread and the second pair of coils for monitoring the flight of the shuttle. Either pair of coils is associated with an individual permanent magnet 26 or 39, respectively, disposed on a rotating disc 25.

Similar components in FIG. 11 and FIG. 7 are labeled with similar reference numerals. Thus, the evaluation circuitry 30 through 34, trigger circuitry 27,28, gate 35 connected to the outputs of both that circuitries, and stop device 36 in these Figures correspond to each other.

As may be seen from FIG. 11 coil windings 23,23' of the weft thread monitor are arranged near the ends of lathe beam 20. By such an arrangement the weft or filling thread is sampled in a relatively late phase of the shuttle flight, which is desirable in order to detect thread breaks also in this phase. The coil windings 38,38' of the shuttle flight monitor are disposed nearer to the middle of the lathe beam which is advantageous for stopping the weaving loom in time when the shuttle moves too slow.

With the weaving loom working, disc 25 rotates in the sense of the arrow, so that firstly permanent magnet 39 on passing over trigger coil 27 gives rise to a trigger pulse which in each working cycle of the weaving loom renders effective one of the windings 38,38'. That means that on normal weft thread travel a thread travel signal is generated indicating that the shuttle flight is regular and the weft or filling thread is intact. In this event the stop device 36 is not operative. However, when no thread travel signal appears in the trigger interval as a result of slow shuttle flight the weaving loom will be stopped in time. Thus, the pair of windings 38,38' provides for monitoring the shuttle flight as well as the weft or filling thread.

In order to be able to monitor the weft or filling thread up to the passage of the shuttle over the ends of the lathe beam, the pair of windings 23,23' is disposed near these ends. As a result the coil windings 23,23', respectively, are energized by the associated permanent magnet 26 only after the windings 38,38', respectively. The operation of the induction coils of the weft thread monitor has already been described with reference to FIG. 7.

The weft or filling thread monitor described with reference to the drawings may also be used on types of weaving looms other than such comprising a reciprocating shuttle, e.g. on circular weaving looms comprising a circulating shuttle. By way of example such a circular weaving loom is described in U.S. Pat. No. 2,535,369, together with a weft thread monitor using electrodynamical signal generation.

While there are shown and described present preferred embodiments of the invention, it is to be distinctly understood that the invention is not limited thereto, but may be otherwise variously embodied and practiced within the scope of the following claims.

Accordingly, what is claimed is:

1. Equipment for monitoring the yarn travel on a textile machine, comprising piezoelectrical yarn sensing means intended to be arranged at a moving part of the textile machine, and electronic receiving means intended to be mounted outside said moving part of the textile machine; said piezoelectrical yarn sensing means comprising a piezoelectrical transducer element and a yarn sensing member forming a mechanical vibratory system, and an induction coil having a winding electrically connected to the piezoelectrical transducer element; the induction coil winding and piezoelectrical transducer element constituting a first electrical resonant circuit tuned to one of the natural frequencies of said mechanical vibratory system; the electronic receiving means comprising at least one further electrical resonant circuit tuned to said natural frequency.

2. The equipment defined in claim 1, wherein said mechanical vibratory system is fixed to a block having a mass greater than the mass of the mechanical vibratory system, and vibration absorbing bearing material is provided for mounting said block on said moving part of the textile machine.

3. The equipment defined in claim 1, wherein the piezoelectrical yarn sensing means comprises means for supporting the mechanical vibratory system, and vibration absorbing material for attaching the supporting means to said moving part of the textile machine.

4. The equipment as defined in claim 1, wherein said induction coil is provided with a core made of a magnetically soft material.

5. The equipment as defined in claim 4, wherein the core is made of a ferritic material.

6. The equipment as defined in claim 1, wherein the electronic receiving means comprises said at least one further electrical resonant circuit, and electronic evaluation circuitry operationally connected to said at least one further electrical resonant circuit, said electronic evaluation circuitry comprising an input stage exhibiting band pass characteristics for suppressing spurious signals of frequencies other than said natural frequency.

7. The equipment as defined in claim 6, wherein the input stage comprises a band pass amplifier.

8. The equipment as defined in claim 6, wherein the electronic evaluation circuitry comprises a first threshold stage, an integration stage operationally connected to the output of the first threshold stage, and a second threshold stage operationally connected to the output of the integration stage, said stages serving for suppressing shorttime spurious signals of great amplitudes.

9. The equipment as defined in claim 8, wherein the first threshold stage includes a pulse shaper having threshold response.

10. The equipment as defined in claim 6, for use on a loom having a reciprocating lathe beam, further including means provided for generating trigger pulses in unison with the reciprocating lathe beam motion, and gate means having two inputs, one of the inputs being supplied with said trigger pulses, and the other with an output of said evaluation circuitry, for generating pulses stopping the loom when said output of the evaluation circuitry fails to indicate yarn travel upon occurrence of a trigger pulse.

11. The equipment as defined in claim 1 for monitoring filling yarn travel on a loom having a reciprocating lathe beam and a shuttle moving along said lathe beam, wherein the piezoelectrical yarn sensing means is mounted in the shuttle and the at least one further electrical resonant circuit in the lathe beam.

12. Equipment for monitoring yarn travel on a textile machine, comprising yarn sensing means including a piezolelectical transducer element and a yarn sensing member forming a mechanical vibratory system, signal transmitting means including an induction coil having a winding electrically connected to the piezoelectrical transducer element, electronic means for receiving signals produced by said signal transmitting means, said induction coil winding and said piezoelectrical transducer element constituting a first electrical resonant circuit tuned to the frequency of an overtone of said mechanical vibratory system, and said electronic receiving means comprising at least one further electrical resonant circuit tuned to said overtone frequency.

* * * * *